United States Patent [19]

Ericsson

[11] Patent Number: 4,779,529

[45] Date of Patent: Oct. 25, 1988

[54] SQUEEGEE ARRANGEMENT INTENDED FOR SILKSCREEN PRINTERS

[75] Inventor: Sylve J. D. Ericsson, Tumba, Sweden

[73] Assignee: Svecia Silkscreen Maskiner AB, Norsborg, Sweden

[21] Appl. No.: 38,707

[22] Filed: Apr. 15, 1987

[30] Foreign Application Priority Data

Apr. 15, 1986 [SE] Sweden ..... 8601704

[51] Int. Cl.[4] ..... B41F 15/44

[52] U.S. Cl. ..... 101/123

[58] Field of Search ..... 101/123; 118/213, 406, 118/413

[56] References Cited

U.S. PATENT DOCUMENTS

| | | | |
|---|---|---|---|
| 2,684,104 | 7/1954 | Dessart et al. | 101/123 X |
| 3,943,849 | 3/1976 | Vasilantone | 101/123 |
| 4,404,903 | 9/1983 | Cronin | 101/123 |
| 4,589,336 | 5/1986 | Klemm | 101/123 X |
| 4,648,317 | 3/1987 | Bubley et al. | 101/123 |
| 4,668,329 | 5/1987 | Shirataki | 118/413 X |

FOREIGN PATENT DOCUMENTS

| | | | |
|---|---|---|---|
| 754220 | 8/1956 | United Kingdom | 101/123 |

*Primary Examiner*—Clifford D. Crowder

*Attorney, Agent, or Firm*—Burns, Doane, Swecker & Mathis

[57] ABSTRACT

A squeegee arrangement for use with silkscreen printers includes a squeegee and an arrangement for effecting relative movement between the squeegee and a stencil. The squeegee may be raised and lowered away from and onto the stencil. The squeegee and the raising and lowering arrangement are carried by a carrying device (6). The carrying device is rotatably supported at its end parts. An arrangement is also provided for varying the setting angles of the squeegee in relation to the stencil.

4 Claims, 1 Drawing Sheet

SQUEEGEE ARRANGEMENT INTENDED FOR SILKSCREEN PRINTERS

TECHNICAL FIELD

The present invention relates to a squeegee arrangement intended for silkscreen printers and then particularly to a squeegee arrangement of the kind which includes a squeegee, means for providing relative movement between the squeegee and a stencil incorporated in the silkscreen printer, and means for raising and lowering the squeegee away from and towards the stencil.

The principle on which the invention is based can be applied both with silkscreen printers of the kind in which the stencil is held stationary and the squeegee is movable reciprocatingly along the stencil, and of the kind in which the squeegee is held stationary and the stencil is movable reciprocatingly past the squeegee.

For the sake of simplicity the following description, and also to some extent the claims, relates (relate) solely to those constructions in which the stencil is held stationary and the squeegee moves backwards and forwards along the stencil. It will be understood, however, that the invention can also be applied in printers in which the squeegee is stationary.

Silkscreen printers and squeegee assemblies intended therefor are known to the art in many different forms.

As beforementioned, silkscreen printers are known in which either the stencil is stationary and the squeegee assembly movable or vice versa.

In both of these categories of printer it is known to use a squeegee assembly in which the squeegee is intended to push a collection of printing ink or printing paste in a first direction, from one end region of the stencil to the other end region thereof, and to provide a so-called replenisher or filler which is intended to push back residual printing paste from said other end region of the stencil to said one end region thereof, while possibly replenishing the paste so that an agglomeration of printing paste is prepared in readiness for the next time the squeegee is moved.

Sqeegee assemblies are also known in which the squeegee can be caused to engage the stencil at either an acute or an obtuse angle, relative to the forwardly located part of the stencil, so that, inter alia, the thickness of the print can be controlled.

Silkscreen printers are also known to the art in which a print or an impression is made on a substrate in both directions of squeegee movement relative to the stencil.

SUMMARY OF THE INVENTION

Technical Problems

When considering the present state of the art as described above it will be seen that a technical problem resides in the ability to provide, with the aid of simple means, a squeegee arrangement which can be raised and lowered, away from and towards the stencil, in a known manner and with which the squeegee can be caused to engage the stencil in a manner to define with the forwardly located part of the stencil either an obtuse or an acute angle, optionally in both directions of relative movement between the squeegee and the stencil.

It will also be seen that a further technical problem is one of providing conditions which will solve the aforesaid problem while still enabling the separate ink or paste feeder means, necessary in prior art silkscreen printers of this kind, to be entirely dispensed with.

Another technical problem in this regard is one of providing, with the aid of simple means, a squeegee arrangement with which the angle at which the squeegee abuts the stencil can be adjusted to any desired value between predetermined limits, such as to allow the squeegee abutment angle to be adapted to the desired printing result.

Another technical problem in the present context resides in the provision of a squeegee arrangement which can be constructed to dimensions which only exceed the dimensions of a conventional squeegee arrangement to a negligible extent and still solve the aforesaid technical problems.

It will also be seen that a further technical problem resides in the construction of squeegee support devices which are capable of carrying and incorporating the means by which the squeegee is raised and lowered from and towards the stencil.

Finally, another technical problem is one of providing, with the aid of simple means, a squeegee arrangement which requires no separate paste-feeder and which can be used to print in both directions of squeegee movement relative to the stencil, and which can engage the stencil in a manner to define with the forwardly located part of the stencil an obtuse or acute angle irrespective of the direction of relative movement.

SOLUTION

For the purpose of resolving one or more of the aforesaid technical problems the present invention is based on a squeegee arrangement intended for silkscreen printers and incorporates a squeegee, means for effecting relative movement between the squeegee and stencil, and means for raising and lowering the squeegee away from and towards the stencil.

It is proposed in accordance with the present invention that the actual squeegee and the squeegee raising and lowering means are carried by a carrier device. The carrier device is rotatably connected at the ends thereof to the frame or the like of the printer, and means are provided for adjusting the positional setting of the carrier device, and therewith also the squeegee, in relation to the stencil.

In accordance with one particular embodiment, the carrier device is mounted for rotation about a pivot axis located in or adjacent that part of the squeegee intended for coaction with the stencil, where the distance is chosen to exceed at most 5 cm.

In accordance with one advantageous embodiment the carrier device has an elongated U-shape configuration, and two members for raising and lowering the squeegee away from and towards the stencil are arranged adjacent mutually parallel parts.

Said means co-act with the end parts of the carrier device and levers formed therewith.

The means and device comprise pneumatically or hydraulically controlled piston cylinder devices.

In accordance with the invention the squeegee abutment angle shall vary between 30° and 150° in a first direction of relative movement between the stencil and the squeegee.

In a second direction of relative movement between the squeegee and stencil, the squeegee abutment angle can be varied between 30° and 150°.

In accordance with one particularly advantageous embodiment of the invention the squeegee is arranged to move over the agglomeration of printing paste at the end of a printing sequence in a first direction of movement, e.g. by lifting and moving in this raised position over an agglomeration of printing ink or paste displaced by the squeegee in one direction, and then lowering onto the stencil to move the agglomeration of ink or paste in the opposite direction during the return squeegee movement.

It also lies within the scope of the invention to provide means for varying the squeegee abutment angle during the printing stage.

ADVANTAGES

The advantages primarily characteristic of a squeegee arrangement according to the present invention reside in the possibility of printing in both directions of relative movement between the squeegee and stencil and of selectively engaging the squeegee with the stencil in a manner such that the squeegee defines with the forwardly located part of the squeegee an obtuse or an acute angle, irrespective of the direction of relative squeegee movement.

BRIEF DESCRIPTION OF THE DRAWINGS

An embodiment at present preferred and exhibiting features characteristic of the present invention will now be described in more detail with reference to the accompanying drawing, in which.

DESCRIPTION OF A PREFERRED EMBODIMENT

Figure 1:
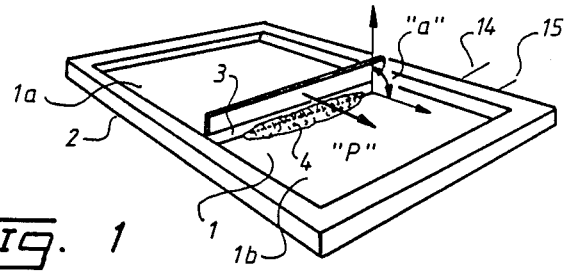
FIG. 1 illustrates in perspective and in greatly simplified fashion the working principles of a silkscreen printer which incorporates a stencil stretched in a stencil frame and a squeegee assembly arranged for movement forwards and backwards over the stencil.

FIG. 1 is a perspective view of a stencil 1 stretched in a frame 2 arranged in a silkscreen printer (not shown), the frame 2 being connected to the printer stand by means not shown in the Figure.

A squeegee 3 is arranged for reciprocating movement across the stencil 1 with the aid of means not shown in the Figure. As indicated by the arrow "P", the squeegee 3 is intended to move from one end region 1*a* of the stencil 1 to the other end region 1*b* thereof, while pushing an agglomeration of printing ink or paste 4 across the stencil.

Part of this paste will pass through holes or perforations (not shown in FIG. 1) in the stencil, onto print material located beneath the stencil 1 and resting against a printing table (not shown).

In FIG. 1 the squeegee 3 is shown to engage the stencil 1 at an abutment angle "a" of 90°. It is known to connect the squeegee to means which will enable the squeegee to be positioned at angles other than 90° in relation to the stencil 1.

The drawings solely illustrate those components of a silkscreen printer which are relevant to an understanding of the present invention. The remaining parts of the printer are well known to one of normal skill in this art, and since they do not form any part of the invention such parts have been omitted for the sake of simplicity.

Figure 2:
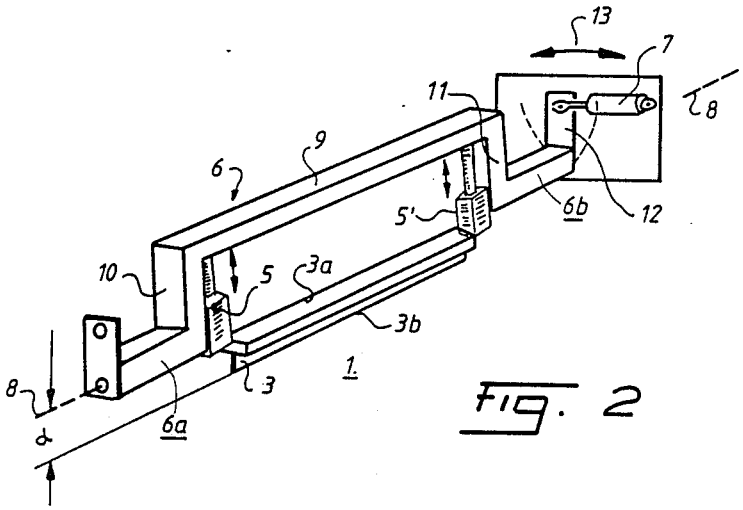
FIG. 2 is a perspective view of a squeegee assembly constructed in accordance with the invention.

FIG. 2 illustrates an embodiment of the inventive squeegee assembly for use in known silkscreen printers and which is intended for connection with appropriate devices therein for effecting relative movement between the squeegee 3, forming part of said assembly, and an underlying stencil. The squeegee 3 is mounted in a squeegee holder 3*a* which, in turn, is mounted for vertical movement in a squeegee carrier generally referenced 6 in FIG. 2. The carrier 6 is of substantially inverted U-shape configuration and comprises a horizontal elongated member 9 which is terminated at each end thereof by two shorter side members 10 and 11 which depend from the horizontal member 9 essentially at right angles thereto and which have located at their lower ends a respective outwardly extending, horizontal arm 6*a*, 6*b*. Each arm 6*a*, 6*b* extending from respective side members 10, 11 has connected thereto an upstanding plate 12, and is provided with journals (not shown) by means of which the carrier 6 is journalled for rotation about a horizontal axis 8. The distance "d" of the rotary axis 8 from the plane of the stencil 1 shall not be greater than 5 cm. The devices by means of which the squeegee holder 3*a*, and thus also the squeegee 3, is moved vertically upwards and downwards between the side members of the carrier 6 are referenced 5 and 5' in FIG. 2, said holder 3*a* being connected to the carrier 6 in a manner to accompany the pivotal movement thereof. The reference 7 in FIG. 2 identifies a device which acts on the pivot journals of the carrier, so as to change, inter alia, the angles at which the squeegee 3 is presented to the plane of the stencil 1. The axis 8 is primarily located in or adjacent that part 3*b* of the squeegee intended for co-action with the stencil.

It will be apparent from the aforegoing that the angle at which the squeegee 3 is presented to the plane of the stencil 1 can be adjusted or changed at any time during a printing sequence, or whensoever desired, simply by actuating the adjuster devices 7. It is preferred in accordance with the invention that the journal means and associated adjuster device 7 are such as to enable the angle "a" which the squeegee defines with the forwardly located part of the underlying stencil to be varied between 30° and 150° in both directions of relative movement between the squeegee and stencil, as indicated by the arrow 13 in FIG. 2.

Preferably, when the desired angle subtended by the squeegee with the forwardly located part of the stencil is greater than 90° there is chosen an angle of between 150° and 100°, preferably between 140° and 120°. The adjuster means 7 and the means 5, 5' for raising and lowering the squeegee in the carrier device preferably comprise conventional pneumatically operated piston-cylinder devices.

In accordance with the invention the squeegee 3 is arranged to move up and over the agglomeration of printing paste at the end of a printing sequence in a first direction (c.f. FIG. 1), e.g. at location 14, for example by raising the squeegee in the carrier device. The raised squeegee is then moved over the ink or paste agglomerate 4 pushed before the squeegee 3 during its movement in said first direction, to a position 15, and is then lowered onto the stencil 1, so as to push the collection of ink or paste towards the other end region in a second movement direction.

The squeegee is thereby raised at the end of a printing sequence and moved, while raised, over the ink or paste agglomerate pushed by the squeegee to the one end region and then lowered onto the stencil, so as to push the ink or paste towards the other end region of the stencil during movement in this direction. This eliminates the need for a mechanical ink feeder arrangement.

As an alternative to the squeegee raising and lowering means 5, 5', or complementary thereto the squeegee may be caused to move in a short arcuate path, by relating the axis 8 of rotation of the carrier device 6 to an arcuate movement with the centre of the arc located beneath the printing table. This can be effected with the aid of pivotable arms not shown.

It also lies within the scope of the invention to vary the abutment angle "a" during the printing sequence, and even to an extent such that the angle "a" is an obtuse angle at the initial stage of a printing stage and an acute angle at the end of the same printing sequence.

It also lies within the scope of the invention for the abutment angle to be acute or obtuse at the initial and fianl stages of a printing sequence, while during other printing sequences the squeegee defines an obtuse or acute angle with the stencil.

It will be understood that the invention is not restricted to the aforedescribed exemplifying embodiment and that modifications can be made within the scope of the following claims.

I claim:

1. A squeegee arrangement for silkscreen printers comprising a single squeegee, having a front, a stencil defining a plane, means for effecting relative movement between said squeegee and said stencil in a first movement direction parallel to said plane of said stencil and in an opposite direction, and means for raising and lowering the squeegee away from and towards the stencil in which the squeegee and squeegee raising and lowering means are supported by a carrier device having an elongated U-shape configuration and wherein the carrier device is mounted for rotation about an axis at its end portions; and further comprising adjuster means for adjusting the positional setting of the carrier device and therewith the squeegee, in relation to the stencil by coacting with respective end portions of the carrier device through arms provided on the carrier device, with the carrier device being mounted for rotation so that the squeegee presents a first angle of abutment with the stencil in the first movement direction in which print is applied, and presents a second angle of abutment with said stencil in the opposite direction of movement in which print is to be applied; wherein the means for raising and lowering the squeegee is incorporated in the carrier device adjacent mutually parallel parts of the U-shape carrier, the squeegee in one terminal position thereof being arranged to rise above the plane of the stencil and to move over an ink/paste agglomeration located in front of said squeegee and to then lower onto the stencil so as to push said ink/paste agglomeration in the opposite direction when a print is to be applied, wherein the squeegee abuts the stencil at an angle in said first movement direction of between 30° and 150° and the squeegee abuts the stencil in the second movement direction between the squeegee and stencil at an angle of between 30° and 150°.

2. A squeegee arrangement according to claim 1, wherein the squeegee raising and lowering means and adjuster means comprise pneumatically controlled piston-cylinder devices.

3. A squeegee arrangement according to claim 1, characterized in that the squeegee is arranged to move over and above the printing ink/paste agglomeration towards the end of a printing sequence.

4. A squeegee arrangement according to claim 1, characterized in that the abutment angle can be varied during the printing sequence.

* * * * *